US012326273B1

(12) United States Patent
Ellert et al.

(10) Patent No.: US 12,326,273 B1
(45) Date of Patent: Jun. 10, 2025

(54) PLENUM CONVERSION KIT FOR HVAC SYSTEM AND METHOD OF INSTALLATION

(71) Applicants: Bryce Ellert, Calgary (CA); Landon Johnston, Calgary (CA)

(72) Inventors: Bryce Ellert, Calgary (CA); Landon Johnston, Calgary (CA)

(73) Assignees: Bryce Ellert, Calgary (CA); Landon Johnston, Calgary (CA)

( * ) Notice: Subject to any disclaimer, the term of this patent is extended or adjusted under 35 U.S.C. 154(b) by 0 days.

(21) Appl. No.: 18/661,885

(22) Filed: May 13, 2024

(51) Int. Cl.
*F24F 13/24* (2006.01)
*F24F 13/02* (2006.01)
*F24F 13/20* (2006.01)

(52) U.S. Cl.
CPC ..... *F24F 13/24* (2013.01); *F24F 13/0209* (2013.01); *F24F 13/20* (2013.01)

(58) Field of Classification Search
CPC ..... F24F 13/20; F24F 13/24; F24F 13/0209
USPC ..... 454/284
See application file for complete search history.

(56) References Cited

U.S. PATENT DOCUMENTS 3,620,039 A * 11/1971 Williams ..... F25B 39/02 138/120
5,219,403 A 6/1993 Murphy
6,231,704 B1 5/2001 Carpinetti
6,957,670 B1 10/2005 Kajino
7,018,127 B2 * 3/2006 Walsh ..... F16L 23/14 403/294
8,371,619 B2 2/2013 Boonstra
10,883,739 B2 1/2021 Gray
2011/0156387 A1 6/2011 Hasegawa et al.
2014/0130932 A1 5/2014 Jin et al.
(Continued)

FOREIGN PATENT DOCUMENTS

CA 2865781 A1 1/2016

OTHER PUBLICATIONS

HVAC Direct, Furnace/Col to Plenum Transition Kit, May 30, 2022, https://hvacdirect.com/media/pdf/HVACDirect_Plenum-instructions_Final.pdf (Year: 2022).*
(Continued)

*Primary Examiner* — Avinash A Savani
*Assistant Examiner* — Dana K Tighe
(74) *Attorney, Agent, or Firm* — Argus Intellectual Enterprise, LLC; Daniel Enea; Jordan Sworen

(57) ABSTRACT

A plenum conversion kit for enclosing an evaporator coil within a building's plenum is provided. The kit includes a flat panel, one or more S-cleats, duct tape, screws, and an angle bracket tailored for integrating an air conditioning evaporator coil during HVAC system upgrades or installations. This kit facilitates a seamless transition by allowing the evaporator coil to be installed within the plenum space of existing furnace systems without requiring extensive custom fabrication. The flat panel is designed with dimensions to accommodate common evaporator sizes and includes pre-measured fold lines and cuts to ensure accurate assembly. The primary advantage of this kit is its efficiency and convenience, significantly reducing installation time and material waste by providing all necessary components in one package. Additionally, the design of the kit promotes a stable and secure enclosure for the evaporator, enhancing system performance and durability.

5 Claims, 5 Drawing Sheets

(56) References Cited

U.S. PATENT DOCUMENTS

| | | | | |
|---|---|---|---|---|
| 2022/0341621 | A1* | 10/2022 | Fischer | F16B 5/0225 |
| 2022/0357070 | A1 | 11/2022 | Grimes | |
| 2023/0235918 | A1 | 7/2023 | Santini et al. | |

OTHER PUBLICATIONS

Hyde Heating and Air Conditioning, Making a Sheet Metal Plenum Transition, Apr. 17, 2021, https://www.youtube.com/watch?v=vfmiR48-Jkw (Year: 2021).*

Hammer and Rack, Easy DIY HVAC duct sealing of the bypass duct gap by taping, Apr. 24, 2021, https://www.youtube.com/watch?v=I8anQmN_6BM (Year: 2021).*

Metal Roofing Screws.com, #8 × ½" Gutter and Downspout and Sheet Metal Screws, Nov. 21, 2019, https://www.metalroofingscrews.com/ products/8-x-1-2-sheet-metal-screws?srsltid=AfmBOoqXY_-Zww1SM9DCA1YN7rP4ssM6fmvESQrjtmld82haMt-H8jo_ (Year: 2019).* https://hvacdirect.com/precision-duct-furnace-coil-to-plenum-transition-kit.html Precision Duct Furnace/Coil to Plenum Transition Kit Jan. 30, 2024.

https://www.alpinehomeair.com/product/ducting-sheet-metal/sheet-metal-transition-kits/alpine-home-air-products/kit081 Sheet Metal Transition Kit (no bender) Jan. 30, 2024.

* cited by examiner

PLENUM CONVERSION KIT FOR HVAC SYSTEM AND METHOD OF INSTALLATION

BACKGROUND OF THE INVENTION

The present invention relates to a heating, ventilation, and air conditioning (HVAC) system kit designed for transitioning and enclosing components within these systems. More specifically, the invention provides an HVAC kit designed for transitioning and enclosing components such as a heating furnace to existing ductwork and/or installing an evaporator coil inside the plenum housing.

In the realm of HVAC installations, particularly in settings involving the replacement or installation of furnaces and air conditioning units, there exists a significant challenge associated with integrating new equipment with existing ductwork. This process typically requires custom fabrication of metal plenums and transitions, which can be time-consuming, costly, and require specialized skills.

Currently, technicians often need to manually measure and cut sheet metal to create custom transitions to connect new HVAC units to existing ductwork. This method not only demands considerable labor and expertise but also leads to material waste and potential inaccuracies in fit, which can compromise system efficiency and durability. Furthermore, the installation of evaporator coils within plenum spaces presents additional complexities, as these units must be precisely positioned and secured within the system to ensure optimal functionality and efficiency.

Many of the available kits for facilitating these transitions provide only partial solutions, often lacking the necessary components to cover the full range of sizes and configurations encountered in field installations. These kits may also fail to address noise reduction and vibration dampening, which are critical for maintaining the longevity and effectiveness of the HVAC system.

Moreover, existing solutions typically do not offer the ease and convenience of a complete all-in-one kit, requiring technicians to purchase additional materials and components separately. This not only increases the overall cost of installation but also extends the time required to complete the job, thereby impacting overall efficiency and customer satisfaction.

The present invention provides a comprehensive solution to these issues by offering a plenum conversion kit that includes all necessary components to effectively transition new HVAC units to existing ductwork and to enclose evaporator coils within plenums. The kit is designed to be universally compatible with a variety of HVAC systems and configurations, featuring pre-cut panels with noise-reducing cross breaks and dual hems for enhanced structural integrity and ease of handling. The inclusion of all necessary securing hardware and detailed instructions further facilitates quick and accurate installations, reducing the need for custom fabrication and minimizing labor costs and potential errors.

By addressing the shortcomings of existing systems and methods with a streamlined, versatile, and user-friendly kit, the present invention significantly improves the process of HVAC installations and upgrades. The present invention benefits both technicians and end-users in terms of reduced installation time, improved system performance, and enhanced durability.

In light of the devices disclosed in the known art, it is submitted that the present invention substantially diverges in design elements and methods from the known art and consequently it is clear that there is a need in the art for a method and system for integrating HVAC components. This need is particularly acute for solutions that simplify the installation process, minimize labor and material costs, and enhance the overall efficiency and reliability of the HVAC systems. In this regard, the instant invention substantially fulfills these needs by providing a comprehensive kit that facilitates the easy and efficient transition of HVAC units to existing ductwork and securely encloses evaporator coils within plenum spaces.

SUMMARY OF THE INVENTION

In view of the foregoing disadvantages inherent in the known types of plenum conversion kits now present in the known art, the present invention provides a new plenum conversion kit that is configured to provide a transition of HVAC units to existing ductwork without requiring modified manufacturing of a plenum. In one embodiment, the plenum conversion kit comprises four flat panels, wherein at least one of the flat panels includes a noise-reducing cross break configured to minimize operational vibration. The panels are secured to the surrounding ductwork via one or more S-cleats, wherein each S-cleat includes a first channel open along a first side and a second channel open along an opposing second side. The first and second channel are adapted to receive an edge of the existing ductwork and an edge of one of the flat panels. In this way, the S-cleats join the panels to the existing ductwork.

It is a further objective of the present invention to provide a plenum conversion kit that provides for seamless integration of new furnaces or evaporator coils with existing ductwork, thereby reducing the time and technical challenges typically associated with custom sheet metal fabrication. The pre-cut panels and S-cleats included in the kit are standardized to fit a variety of ductwork configurations. These panels are designed to reduce vibrations via the cross break which protrudes out the first side of the panel.

It is yet another objective of the present invention to provide a plenum conversion kit with noise-reducing cross breaks and a double hem, which serves to minimize operational vibration and improve the durability of the installation. These features ensure that the HVAC system operates more quietly and efficiently, leading to enhanced overall system performance.

It is also an objective of the present invention to provide a plenum conversion kit that is modular and adaptable to various HVAC makes and models. The kit accommodates different sizes and shapes of HVAC units and ductwork. The flat panels and the secure fitting provided by the S-cleats and screws form a plenum that joins the furnace to the ductwork.

It is yet another objective of the present invention to provide an evaporator coil enclosure kit that comprises a secondary flat panel configured to form part of a plenum enclosure. The plenum enclosure is configured to house an evaporator coil therein. S-cleats are provided which are used to secure the flat panel to the one of the flat panels or existing HVAC ductwork. An angle bracket is configured to mount to the one of the flat panels or existing HVAC ductwork for supporting the evaporator coil within the formed plenum enclosure. The evaporator coil enclosure kit may be used with the plenum conversion kit to enclose the evaporator coil within the plenum kit enclosure.

It is therefore an object of the present invention to provide a new and improved plenum conversion kit and evaporator coil enclosure kit that has all of the advantages of the known art and none of the disadvantages. Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
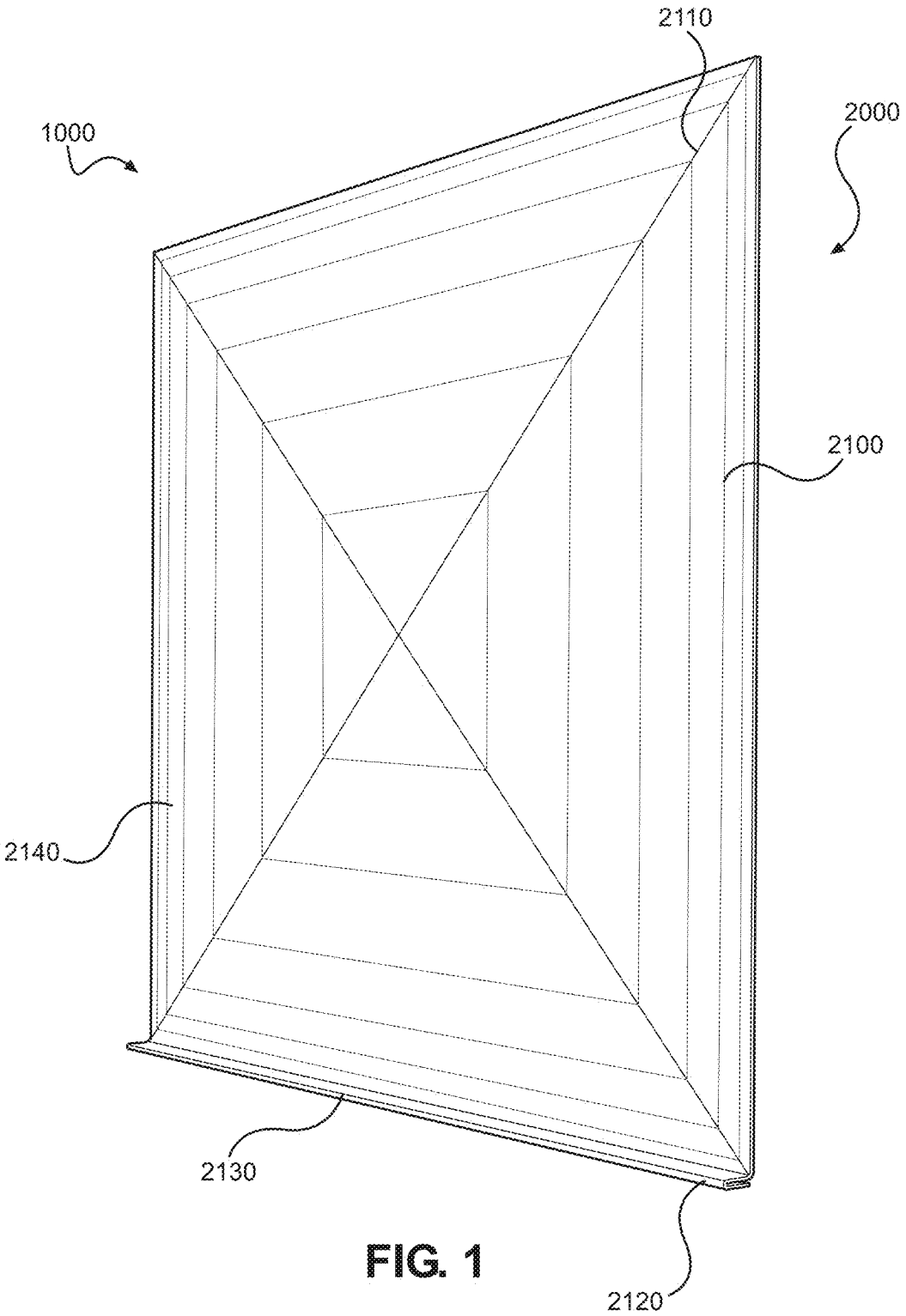
FIG. 1 shows a perspective view of one embodiment of a panel of the plenum conversion kit.

Reference is made herein to the attached drawings. Like reference numerals are used throughout the drawings to depict like or similar elements of the system. For the purpose of presenting a brief and clear description of the present invention, the embodiment discussed will be used with a plenum conversion kit joining a new furnace to existing ductwork, and then an evaporator coil enclosure kit being installed to the plenum enclosure formed by the plenum conversion kit. The figures are intended for representative purposes only and should not be considered to be limiting in any respect. Furthermore, the described features, structures, or characteristics may be combined in any suitable manner in one or more embodiments. In the following description, numerous specific details are provided to give a thorough understanding of embodiments.

Reference will now be made in detail to the exemplary embodiment (s) of the invention. References to "one embodiment," "at least one embodiment," "an embodiment," "one example," "an example," "for example," and so on indicate that the embodiment(s) or example(s) may include a feature, structure, characteristic, property, element, or limitation but that not every embodiment or example necessarily includes that feature, structure, characteristic, property, element, or limitation. Further, repeated use of the phrase "in an embodiment," "first embodiment," "second embodiment," or "third embodiment" does not necessarily refer to the same embodiment.

As used herein "plenum" means a compartment or chamber to which one or more air ducts are connected and forms part of the air distribution system. Plenums are typically located either in the space between the structural ceiling and a drop ceiling or below the floor in buildings with raised floors. In HVAC applications, the plenum acts as a collecting area for the circulation of heated or cooled air, or it can serve as a pressurized housing for air that is being pushed into the ductwork.

Figure 2:
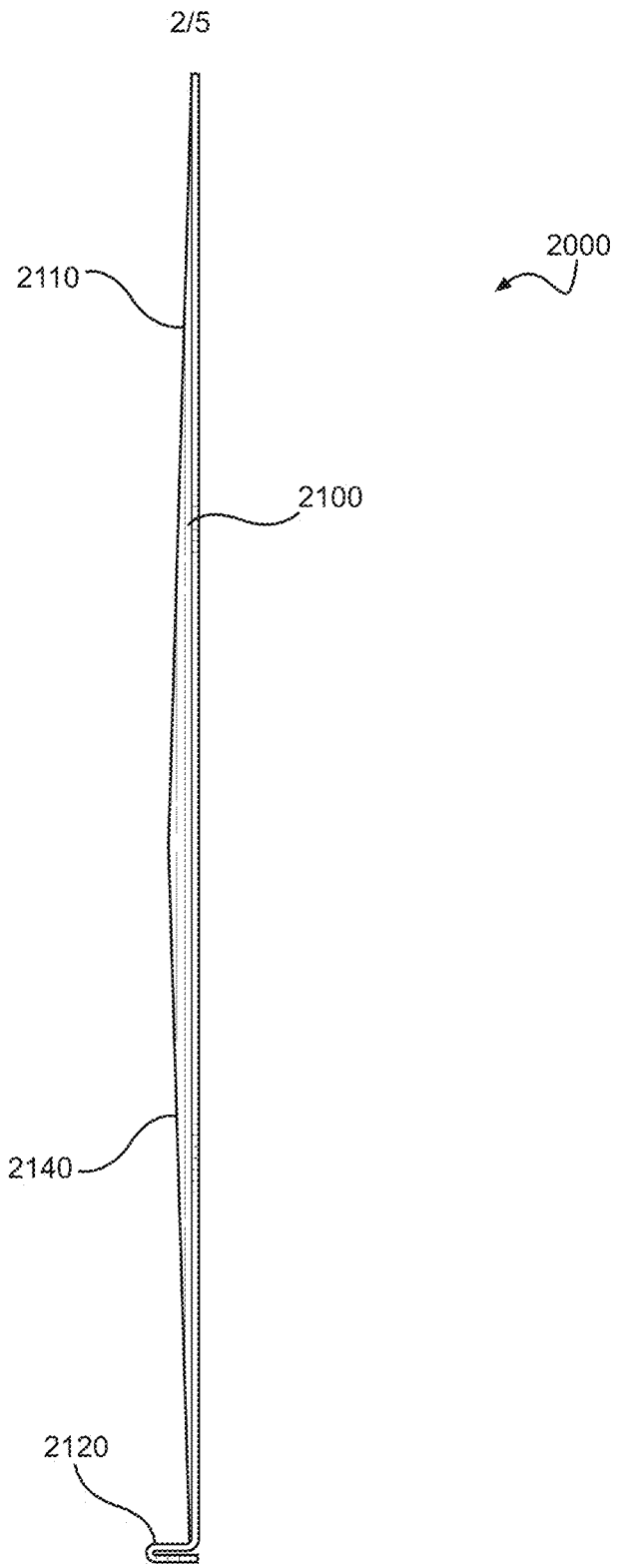
FIG. 2 shows a side view of one embodiment of the panel of the plenum conversion kit.

Referring to FIGS. 1 and 2, there is shown a perspective view and a side view of one embodiment of a panel of the plenum conversion kit, respectively. The plenum conversion kit provides a furnace transition kit that is used to connect a new furnace with existing ductwork. The existing ductwork is often sized for use with an older furnace and is used to transport hot and cool air to and from the furnace. When older furnaces are replaced with a new furnace, they are typically used in the same location, such as a basement of a residential building or a utility room in a commercial building. New furnaces are typically smaller than the older furnaces having a smaller plenum that joins with the forced air supply and forced air return ductwork. The plenum is a pressurized housing that pushes air into the ductwork. The ductwork is typically created to keep the forced air supply separate from the forced air return. The furnace utilizes a heat exchanger that is distributed via a blower into the plenum. The blowers on newer furnaces are smaller and are sized specifically for the existing plenum. The present invention is a plenum conversion kit that forms a transition that is used to connect the new furnace with the existing ductwork.

In one embodiment, the furnace transition kit comprises four flat panels 2100, each panel configured to facilitate the connection of the new furnace to existing ductwork. At a furnace end, the panels are cut to size and width, and tapered to the size and width at the ductwork end. At least one panel includes a noise-reducing cross break 2110 that protrudes from one side. The cross break 2110 minimizes operational vibration and enhances the overall system performance. Each flat panel 2100 features a hem 2120 along one edge 2130, which also protrudes from the first side 2140. This hem 2120 is strategically configured to not only increase the structural integrity of the panel when attached to the ductwork but also to provide a smooth surface that facilitates safer and more comfortable handling during installation. This combination of features in the panels and S-cleats enhances the ease of installation and operational stability of the HVAC system.

Referring specifically to FIG. 2, the flat panel is shown having a hem along one edge. In one embodiment, the hem 2120 is a double hem, which not only enhances the mechanical fit with the ductwork but also contributes significantly to reducing noise and vibration transmission through the ductwork. This double hem is shaped to facilitate a friction fit with existing ductwork, ensuring a smooth and secure installation process. In one embodiment, the panel 2100 is galvanized steel sheet metal. In alternative embodiments, aluminum or stainless steel are used to form the flat panels. The double hem positioned on at least one edge of the flat panel is a type of fold where the edge of the sheet metal is folded back on itself twice. This creates a rounded, smooth edge that significantly enhances both the appearance and safety of the finished piece. This bending of the edge encapsulates the raw edge within the folds and increases the structural integrity of the assembly when attached to the ductwork.

In the shown embodiment, the cross break 2110 are shallow bends or creases formed in a cross or "X" pattern on sheet metal used in the construction of plenum panels. They significantly increase the rigidity and stability of the metal panels. By introducing these bends, the panels' susceptibility to flexing and bending under stress is reduced. This enhancement is crucial in environments like HVAC plenums, where the integrity of the structure must withstand varying internal pressures and the mechanical stresses of regular HVAC operations. HVAC systems, particularly when the air handler or blower is operational, naturally generate vibrations. These vibrations can cause large, flat metal surfaces to resonate, which in turn can lead to noise and structural wear over time. These cross breaks 2110 disrupt the flat panel's large surfaces making them less prone to uniform vibration and thereby reducing the transmission of these vibrations through the ductwork. Moreover, the reduction in vibration contributes to a quieter HVAC operation.

In the illustrated embodiment, the hem 2120 and the cross break 2110 protrude on the same side of the flat panel 2100. This arrangement provides structural integrity of the panel 2100 wherein the double hem at the edge significantly improves the stiffness and strength of the edges, the cross break imparts additional rigidity across the wider surface area of the panel.

Figure 3:
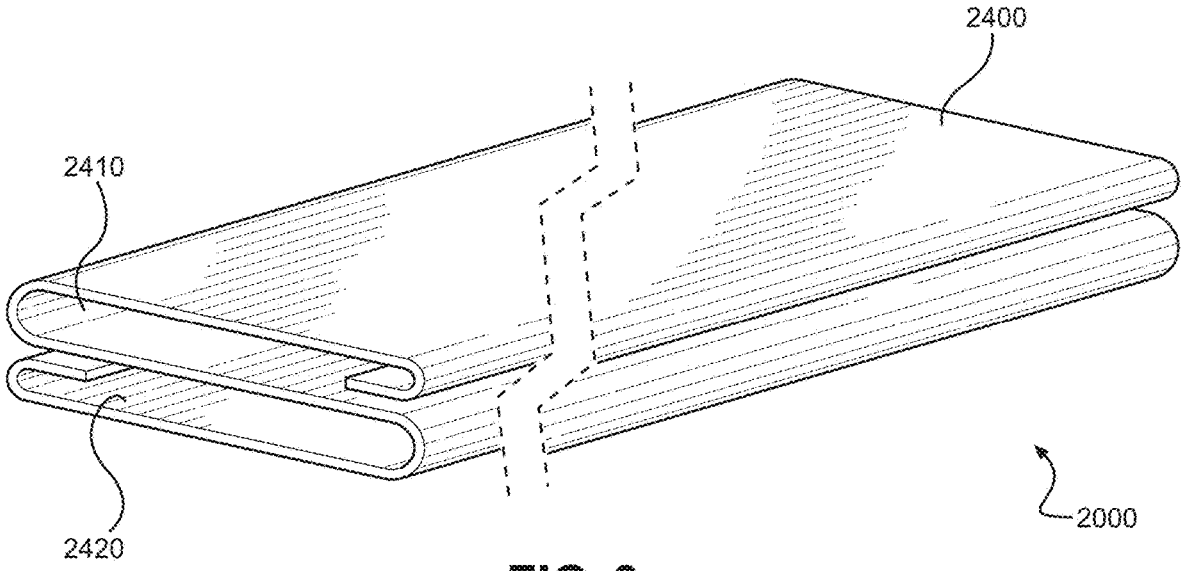
FIG. 3 shows a perspective view of one embodiment of the S-cleat of the plenum conversion kit and evaporator coil enclosure kit.

As shown in FIG. 3, the kit includes one or more S-cleats used to mechanically secure the flat panels to the ductwork. In the shown embodiment, each S-cleat 2400 comprises a dual-channel configuration, having a first channel 2410 open along a first side and a second channel 2420 other along an opposing second side. Both channels 2410, 2420 are adapted to engage one edge of the existing ductwork and an edge of one of the flat panels, thereby forming a secure attachment. Tape or other fasteners are used to seal any seam formed between adjacent flat panels that are secured to the ductwork. In this way, a plenum enclosure is formed.

In the illustrated embodiment, the S-cleat 2400 is sized to secure the flat panels to the existing ductwork or to each other. The length of the S-cleat 2400 may be 20 inches long, however in alternative embodiments the length may be longer and cut to a desirable size. The dual-channel S-cleat includes the first channel 2410 that is sized and configured to receive the edge of the existing ductwork, while the second channel 2420 is adapted to receive the edge of one of the flat panels. This ensures secure fit therebetween. In one embodiment, the S-cleats, like the flat panels, are galvanized steel. The S-cleats hold the panels in place and contribute to the overall sturdiness of the system to prevent any potential misalignments or gaps that could affect the system's performance.

Figure 4:
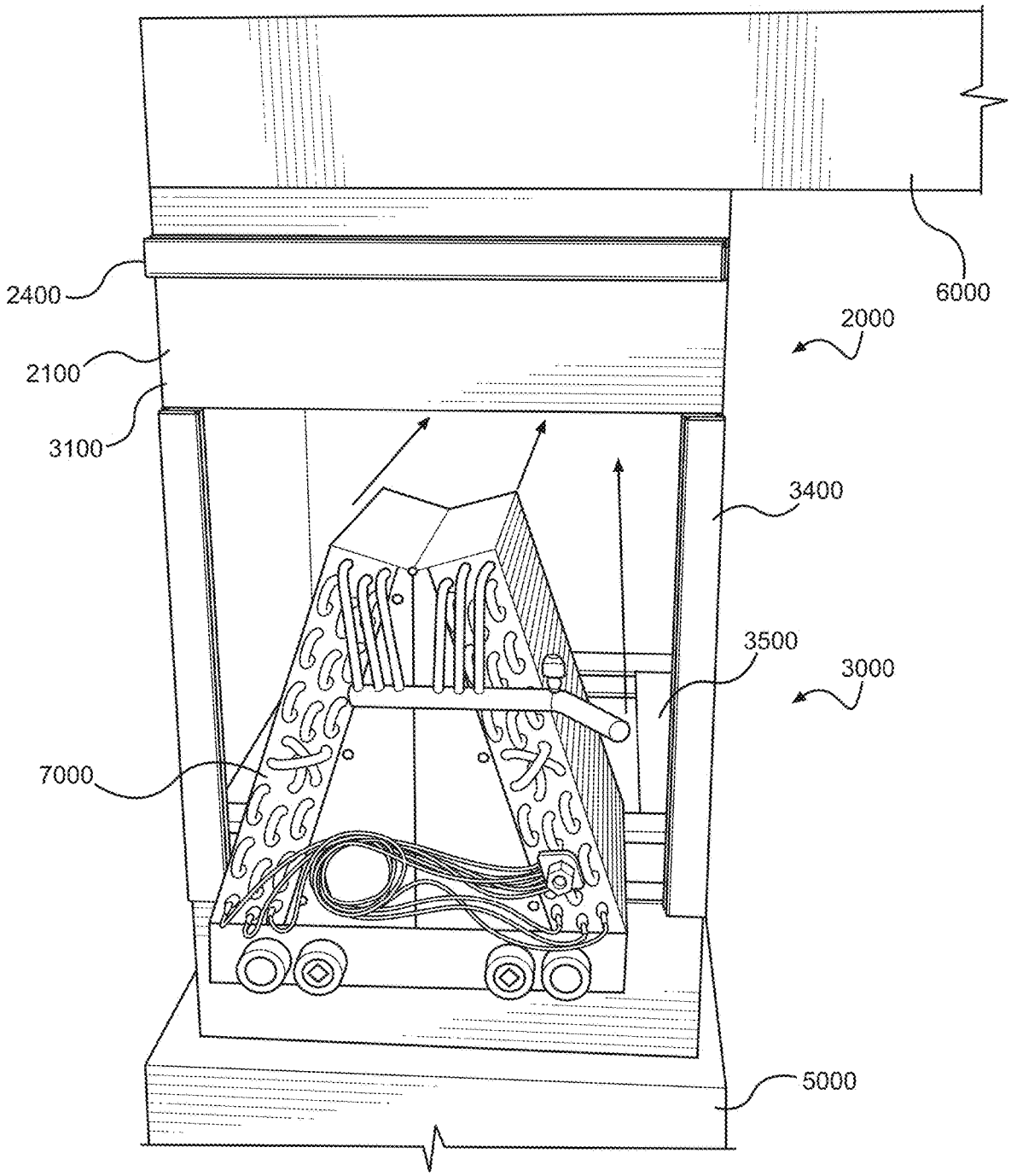
FIG. 4 shows a perspective view of one embodiment of the plenum conversion kit installed and connecting a furnace to a ductwork forming a plenum enclosure, with the evaporator coil enclosure kit being installed thereto.
Figure 5:
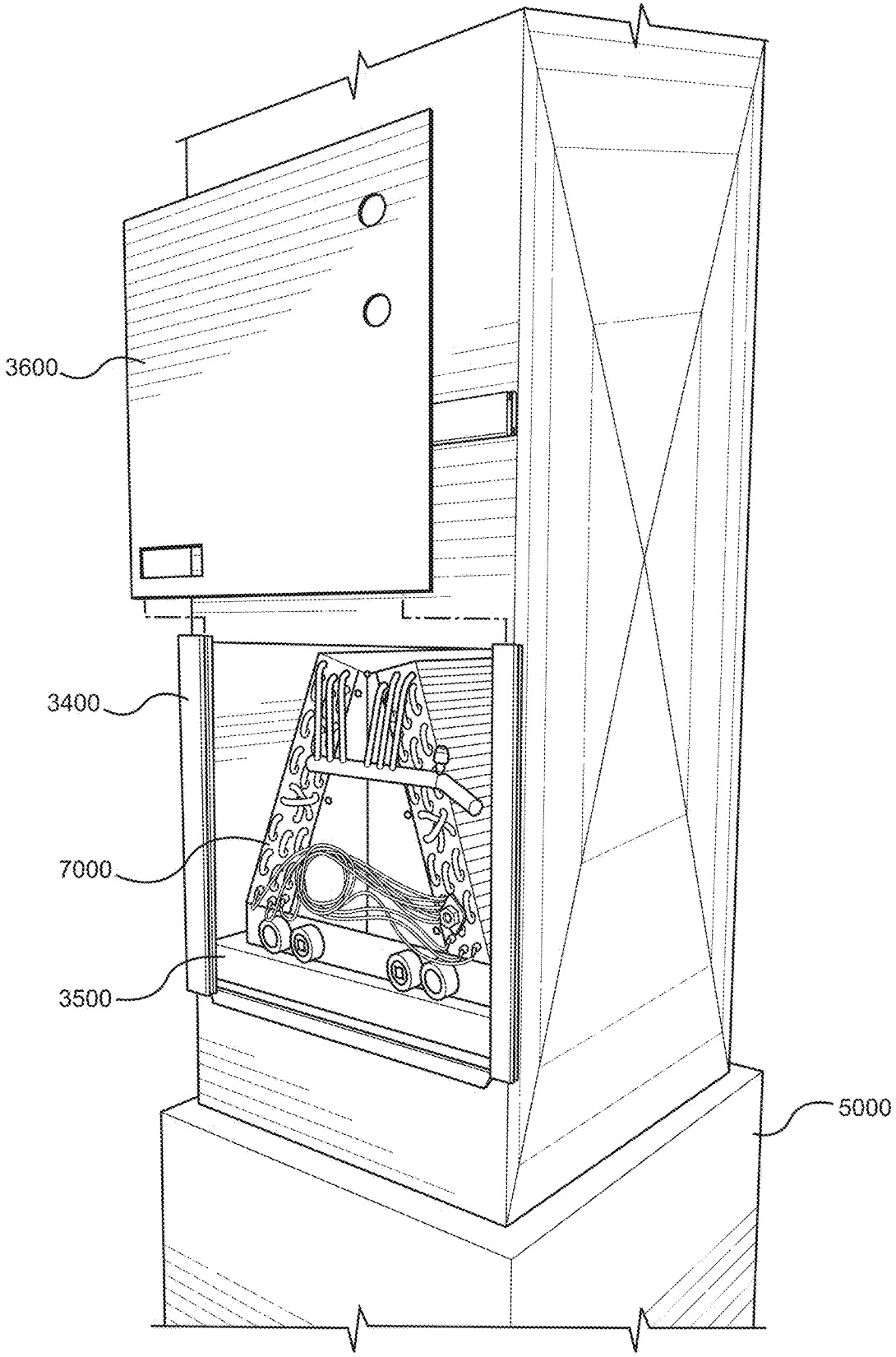
FIG. 5 shows a perspective view of one embodiment of one embodiment of the evaporator coil enclosure kit having an evaporator coil being installed within the plenum enclosure.

Referring to FIGS. 4 and 5, there is shown a perspective view of one embodiment of the plenum conversion kit installed and connecting a furnace to a ductwork forming a plenum enclosure, with the evaporator coil enclosure kit being installed thereto and a perspective view of one embodiment of one embodiment of the evaporator coil enclosure kit having an evaporator coil being installed within the plenum enclosure, respectively. Referring specifically to FIG. 4, the plenum conversion kit 2000 with flat panel 2100 and S-cleats 2400 of FIGS. 1 and 2 are shown installed connecting a new furnace 5000 to existing ductwork 6000 and forming a plenum enclosure. In this figure, an evaporator coil enclosure kit is being used to modify one of the flat panels of the plenum conversion kit. An evaporator coil is shown being installed within the plenum enclosure and above the furnace.

In the shown embodiment, the evaporator coil enclosure kit includes a secondary flat panel configured to form part of the plenum enclosure when closed therewith. The evaporator coil enclosure kit is used when an evaporator coil is to be installed within the plenum enclosure and an opening is formed within one of the panels of the plenum. The plenum enclosure is designed to house an evaporator coil 7000 effectively within the HVAC system's plenum. The evaporator coil typically comprises a network of tubes filled with refrigerant that absorb heat from the air passing over them. The refrigerant inside the evaporator coil is designed to evaporate at a low temperature, capturing heat from the indoor air as the air handling unit blows it across the coil. As shown, the evaporator coil is disposed near the furnace air blower to ensure efficient transfer of heat. Moreover, positioning the evaporator coil in the plenum enclosure allows the cooled air to be evenly distributed throughout the building via the ductwork system.

The evaporator coil enclosure kit 2000 includes a plurality of S-cleats 2400, which are similar to the S-cleats shown in FIG. 3. These S-cleats 2400 are used to secure the secondary flat panel to either one of the flat panels already part of the system or directly to the existing HVAC ductwork. An angle bracket 3500 is also provided as part of this kit which is configured to mount to the flat panel or existing ductwork. The angle bracket 3500 supports the evaporator coil thereon and within the plenum enclosure. The angle brackets 3500 are fastened to the flat panels of the plenum enclosure which raises the evaporator coil above the furnace. In the shown embodiment of FIG. 5, the secondary flat panel is configured to complement the plenum structure by housing the evaporator coil. An access panel is positioned over the opening in the plenum and a template for forming holes therethrough may be provided. The holes provide access to controls or provide a pass through for pipes and the like.

In one embodiment, a method for installing HVAC system components using a plenum conversion kit and steps required for integrating an evaporator coil into the plenum enclosure. The method comprises providing a kit, cutting, and adjusting the secondary flat panel to fit a measured area of the plenum enclosure, and securing the secondary flat panel in place using the S-cleats and screws. The kit comprises: a secondary flat panel configured to form part of a plenum enclosure, wherein the plenum enclosure configured to house an evaporator coil therein; a plurality of S-cleats for securing the flat panel to one of the flat panels or existing HVAC ductwork; an angle bracket 3500 configured to mount to one of the flat panels or existing HVAC ductwork, the angle bracket 3500 configured to support the evaporator coil within the formed plenum enclosure.

In one embodiment, the method further comprises securing the angle bracket 3500 the flat panels or existing HVAC ductwork and mounting an evaporator coil to the angle bracket 3500, wherein mounting the evaporator coil includes adjusting the angle bracket 3500 to accommodate the dimensions and weight of the evaporator coil. Moreover, each S-cleat comprises a first channel open along a first side and a second channel open along an opposing second side, wherein the first and second channel are adapted to receive an edge of the existing ductwork and an edge of the flat panel, respectively. In one embodiment, the secondary flat panel is installed with a front access cover that is removable for maintenance and inspection of the evaporator coil, the access cover being formed from the same or similar material as the secondary flat panel.

In one exemplary embodiment of the installation process, the secondary flat panel is positioned at the designated location within the plenum. This panel is cut according to the specific dimensions of the plenum enclosure to ensure a precise fit. The secondary flat panel is appropriately sized and cut, it is secured in place using the S-cleats provided in the kit. The two channels in the S-cleat are used to receive the edge of the existing plenum while the opposite channel fits the edge of the secondary flat panel. The angle bracket 3500 is then attached to either the flat panel or the existing ductwork, depending on the specific setup of the HVAC system. This bracket 3500 is engineered to support the weight and dimensions of the evaporator coil. Adjustments to the angle bracket 3500 may be necessary to align with the dimensions and weight of the evaporator coil, ensuring that the coil is adequately supported and positioned within the plenum. With the angle bracket 3500 in place, the evaporator coil is then mounted onto the bracket 3500. Finally, the front access cover is installed on the secondary flat panel. This cover is made from the same or similar material as the panel, providing a consistent look and feel while allowing easy access to the evaporator coil for any necessary service or repairs. The access cover is designed to be removable, which simplifies the process of inspecting and maintaining the coil, thereby ensuring the system remains in optimal operating condition.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A plenum conversion kit for HVAC systems, comprising:

four flat panels configured to connect a new furnace or air conditioner to an existing ductwork, each flat panel is adapted to fit various ductwork dimensions by sizing a first furnace end to a second existing ductwork;

wherein the four flat panels include a noise-reducing cross break configured to minimize operational vibration;

wherein the cross break protrudes out a first side;

one or more S-cleats adapted to mechanically secure each flat panel to the existing ductwork;

wherein each of the one or more S-cleats includes a first channel open along a first side and a second channel open along an opposing second side, wherein the first and second channel are adapted to receive an edge of the existing ductwork and an edge of one of the flat panels, respectively;

wherein each flat panel includes a hem along one edge, the hem protruding out the first side;

wherein the hem is configured to increase the structural integrity of the flat panel when attached to the ductwork and form a smooth surface to handle;

wherein the hem is a double hem, the double hem shaped to facilitate a friction fit with existing ductwork.

2. The plenum conversion kit of claim 1, further comprising a duct tape and a plurality of screws for assembling and securing each panel to the existing ductwork to form an air-tight installation.

3. The plenum conversion kit of claim 2, wherein the screws are hex head, size #8×½" length, configured to puncture the panels without pre-drilling.

4. The plenum conversion kit of claim 1, wherein the flat panels comprise galvanized sheet metal to prevent corrosion and enhance durability.

5. The plenum conversion kit of claim 1, further comprising an evaporator coil enclosure kit for HVAC systems, the evaporator coil enclosure kit comprising:

a secondary flat panel configured to form part of a plenum enclosure, the plenum enclosure configured to house an evaporator coil therein, a plurality of S-cleats for securing the flat panel to the one of the four flat panels or existing HVAC ductwork;

an angle bracket configured to mount to the one of the flat panels or existing HVAC ductwork for supporting the evaporator coil within the formed plenum enclosure.

* * * * *